US006753813B2

(12) United States Patent
Kushihi

(10) Patent No.: US 6,753,813 B2
(45) Date of Patent: Jun. 22, 2004

(54) SURFACE MOUNT ANTENNA, METHOD OF MANUFACTURING THE SURFACE MOUNT ANTENNA, AND RADIO COMMUNICATION APPARATUS EQUIPPED WITH THE SURFACE MOUNT ANTENNA

(75) Inventor: Yuichi Kushihi, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 18 days.

(21) Appl. No.: 10/170,469

(22) Filed: Jun. 14, 2002

(65) Prior Publication Data

US 2003/0020659 A1 Jan. 30, 2003

(30) Foreign Application Priority Data

Jul. 25, 2001 (JP) ..... 2001-224572

(51) Int. Cl.[7] ..... H01Q 1/38

(52) U.S. Cl. ..... 343/700 MS; 343/702; 343/848

(58) Field of Search ..... 343/700 MS, 702, 343/846, 848, 873

(56) References Cited

U.S. PATENT DOCUMENTS 5,760,746 A * 6/1998 Kawahata ..... 343/702
6,100,849 A * 8/2000 Tsubaki et al. ..... 343/702
6,281,848 B1 * 8/2001 Nagumo et al. ..... 343/700 MS
6,476,767 B2 * 11/2002 Aoyama et al. ..... 343/700 MS

* cited by examiner

*Primary Examiner*—Shih-Chao Chen
(74) *Attorney, Agent, or Firm*—Keating & Bennett, LLP

(57) ABSTRACT

A surface mount antenna includes a substrate and a radiation electrode (having a predetermined resonance frequency) disposed on the substrate. An electrode is formed to cover four continuously connected surfaces including the front surface, the front end surface, the rear surface and the rear end surface of each substrate. Then, a dicer is used to cut a slit on the radiation electrode formed on the surface of the dielectric substrate. Here, the slit is arranged in a direction intersecting a direction α connecting the two end surfaces. Subsequently, the dielectric substrate is cut into a plurality of portions along the direction α, thus producing a plurality of surface mount antennas each including a substantially rectangular substrate and a radiation electrode formed essentially surrounding an outer circumference of the substrate.

25 Claims, 7 Drawing Sheets

SURFACE MOUNT ANTENNA, METHOD OF MANUFACTURING THE SURFACE MOUNT ANTENNA, AND RADIO COMMUNICATION APPARATUS EQUIPPED WITH THE SURFACE MOUNT ANTENNA

BACKGROUND OF THE INVENTION

1. Field of the Invention

The present invention relates to a surface mount antenna which can be mounted on a circuit board of a radio communication apparatus, a method of manufacturing the surface mount antenna, as well as a radio communication apparatus equipped with such a surface mount antenna.

2. Description of the Related Art

An antenna (surface mount antenna) which can be mounted on a circuit board of a radio communication apparatus includes a chip-like substrate (for example, a dielectric substrate), and a radiation electrode disposed on the chip-like substrate for transmitting and receiving communication signals (electromagnetic wave). Such a surface mount antenna may be manufactured by performing a plating treatment on the chip-like substrate so as to form an electrode, followed by an etching treatment in which the electrode is etched so as to have a predetermined shape, thereby obtaining a desired radiation electrode. Alternatively, an amount of paste material for forming a thick-film electrode is printed on to the surface of the chip-like substrate so as to form an electrode having a predetermined shape, followed by drying and sintering the printed paste material, thereby obtaining a desired surface mount antenna.

However, a surface mount antenna is usually small in size. Conventionally, since a surface mount antenna is produced individually by forming a radiation electrode on each small chip-like substrate, it is difficult to ensure high production efficiency, hence making it difficult to produce the surface mount antenna at a low cost.

Moreover, since it is extremely difficult to produce a great number of dielectric substrates having sizes and dielectric constants that are exactly the same as one another, it is extremely difficult for many radiation electrodes to have exactly the same resonance frequency. In order to inhibit such non-uniformity among the resonance frequencies of many radiation electrodes, it might be necessary to adjust, with very high precision, the shape of the radiation electrodes by taking into account the sizes and dielectric constants of many radiation electrodes. However, since each radiation electrode is extremely small in size, it is extremely difficult to perform such an adjustment of the shape of each radiation electrode.

Moreover, if the resonance frequency of the radiation electrode of each surface mount antenna is to be changed, it will be necessary to newly design the shape and size of each radiation electrode, as well as to newly design the size of each dielectric substrate, hence requiring a considerable amount of time and labor.

SUMMARY OF THE INVENTION

In order to overcome the problems described above, preferred embodiments of the present invention provide an improved surface mount antenna which permits a high production efficiency in its manufacturing process and allows an easy adjustment of the resonance frequency of the radiation electrode of each surface mount antenna, as well as an easy change in designing such an antenna. In addition, preferred embodiments of the present invention provide a method for manufacturing such an improved surface mount antenna, as well as a radio communication apparatus equipped with such an improved surface mount antenna.

According to a first preferred embodiment of the present invention, a surface mount antenna includes a substantially rectangular substrate and a radiation electrode disposed on the substantially rectangular substrate for performing an antenna function. In detail, the radiation electrode is disposed on four continuously connected surfaces including a top end surface, a bottom surface, and two shorter edge surfaces of the substrate, thereby forming a configuration essentially surrounding an outer circumference of the substrate. Specifically, a slit is formed in a direction intersecting an outer circumferential direction of the substrate and extends across the whole width of the radiation electrode. In particular, at least one of two electrode ends located close to each other with the slit interposed therebetween is cut for adjusting the resonance frequency of the radiation electrode.

According to a second preferred embodiment of the present invention, a method of manufacturing a surface mount antenna includes the steps of forming an electrode to entirely cover the top and bottom surfaces as well as two mutually opposite shorter edge surfaces of a dielectric substrate, forming a slit on the electrode disposed on the surface of the dielectric substrate, the slit being formed by cutting with a dicer and arranged in a direction intersecting a direction connecting the two shorter edge surfaces, cutting the dielectric substrate into a plurality of portions, using a dicer which cuts along the direction connecting the two end surfaces, and producing a plurality of surface mount antennas each including a substantially rectangular substrate and a radiation electrode formed to essentially surround the substantially rectangular substrate. In particular, when the dicer is used to cut the slit so that the slit is formed on the electrode attached to the surface of the dielectric substrate, the slit is formed at a position and having a width both corresponding to a predetermined resonance frequency of the radiation electrode of a surface mount antenna.

According to a third preferred embodiment of the present invention, another method of manufacturing a surface mount antenna includes the steps of forming an electrode to entirely cover the top and bottom surfaces as well as two mutually opposite shorter edge surfaces of a dielectric substrate, forming on the surface of the dielectric substrate, an electrode having a slit formed in a direction intersecting a direction connecting the two shorter edge surfaces, cutting the dielectric substrate into a plurality of portions, using a dicer which cuts along the direction connecting the two end surfaces, and producing a plurality of surface mount antennas each including a substantially rectangular substrate and a radiation electrode formed to essentially surround the substantially rectangular substrate. In particular, before the dielectric substrate is cut by a dicer into a plurality of portions, at least one of two electrode ends located close to each other with the slit interposed therebetween is cut by the dicer, so as to adjust the resonance frequency of the radiation electrode of each surface mount antenna to a predetermined resonance frequency.

According to another preferred embodiment of the present invention, either a plating treatment or a thick-film electrode formation method is preferably used to form an electrode on the dielectric substrate.

According to a further preferred embodiment of the present invention, a radio communication apparatus includes a surface mount antenna formed according to various preferred embodiments described above.

According to preferred embodiments of the present invention, the radiation electrode of each surface mount antenna is formed over four continuously connected surfaces including a top surface, a bottom surface and two shorter edge surfaces of a dielectric substrate, thereby forming a configuration essentially surrounding an outer circumference of the substrate. Further, a slit is provided on the radiation electrode, arranged in a direction intersecting the circumferential direction of the substrate and extending across the whole width of the radiation electrode. Moreover, an open end is formed. In addition, since the slit position and the slit width are variable, it is possible to change an electric length extending from a feeding section that is predetermined in the radiation electrode to the open end (an electrode end which is an edge of the slit), thereby making it possible to change the resonance frequency of the radiation electrode.

In preferred embodiments of the present invention, since the resonance frequency of the radiation electrode can be easily adjusted by using a dicer to change the slit position and the slit width, it is possible to easily and quickly perform any design change desired. Further, since the radiation electrode has an extremely simple shape, it can be easily manufactured. For example, the above-described surface mount antenna may be easily manufactured by using the above-described manufacturing method. More specifically, with the use of the method of preferred embodiments of the present invention, it is possible to produce a plurality of surface mount antennas in only one operation, thereby greatly reducing the production cost. Further, since a dicer can be used to process (with a high precision) an electrode, it is easy for the radiation electrode to obtain a predetermined resonance frequency by adjusting the slit position and the slit width.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Several preferred embodiments of the present invention will be described in the following with reference to the accompanying drawings.

Figure 1A:
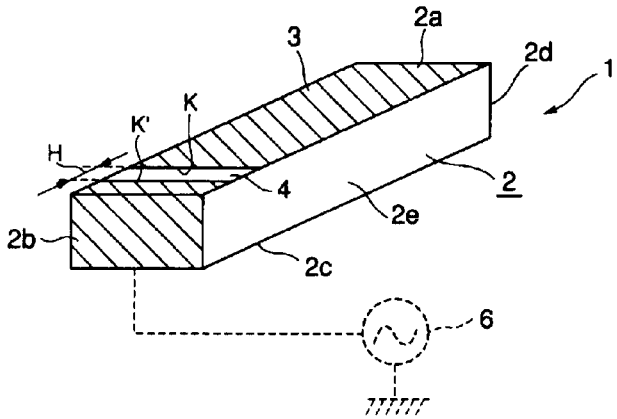
FIGS. 1A to 1C are explanatory views schematically showing an example of a surface mount antenna according to a first preferred embodiment of the present invention.
Figure 1B:
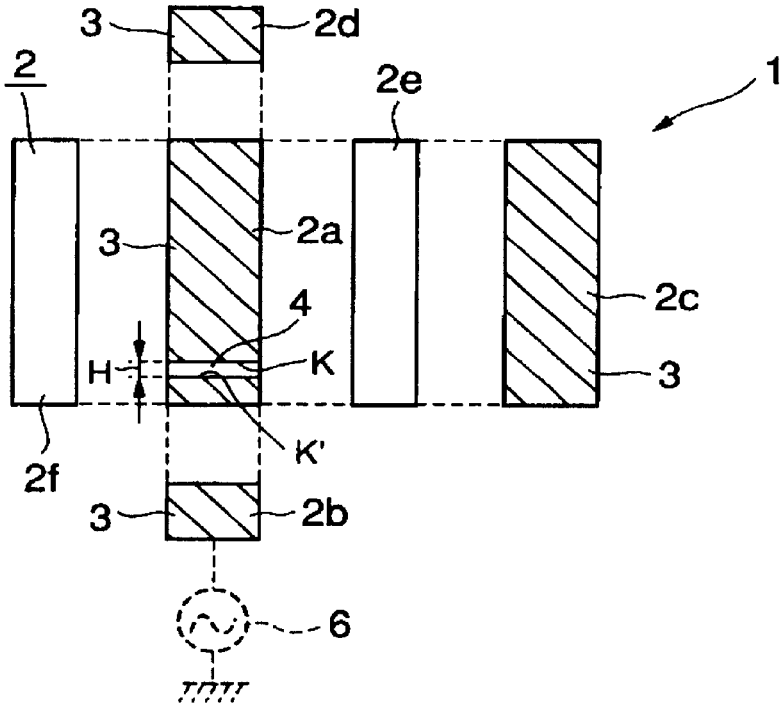

FIG. 1A is an explanatory perspective view schematically showing a surface mount antenna according to a first preferred embodiment of the present invention, which antenna is produced for use, for example, in a radio communication apparatus. FIG. 1B is an explanatory extended view showing the surface mount antenna illustrated in FIG. 1A. However, since a radio communication apparatus is allowed to be constructed in any manner, the first preferred embodiment of the present invention can be applied to any radio communication apparatus except for the construction of the surface mount antenna included therein. For this reason, disclosure of the present invention will not include an explanation of a radio communication apparatus except for the construction of the surface mount antenna included therein.

According to the first preferred embodiment of the present invention, a surface mount antenna 1 preferably includes a substantially rectangular substrate 2 that is preferably made of a dielectric material. A radiation electrode 3 is formed by covering four continuously connected surfaces including a top surface 2*a*, a first shorter side edge surface 2*b*, a bottom surface 2*c* and a second shorter side edge surface 2*d* of the substrate 2. More specifically, the radiation electrode 3 is formed so that it substantially covers the outer circumference of the substrate 2.

The radiation electrode 3 is formed so that a slit 4 is provided and an open end K is formed on the top surface 2*a* of the substrate 2. In fact, the slit 4 is formed along a direction that intersects an outer circumferential direction of the radiation electrode (in a direction substantially perpendicular to such an outer circumferential direction, as shown in an example of the accompanying drawings), extending across an entire width of the radiation electrode 3, and having a width H which is constant along the entire length of the slit.

Figure 1C:
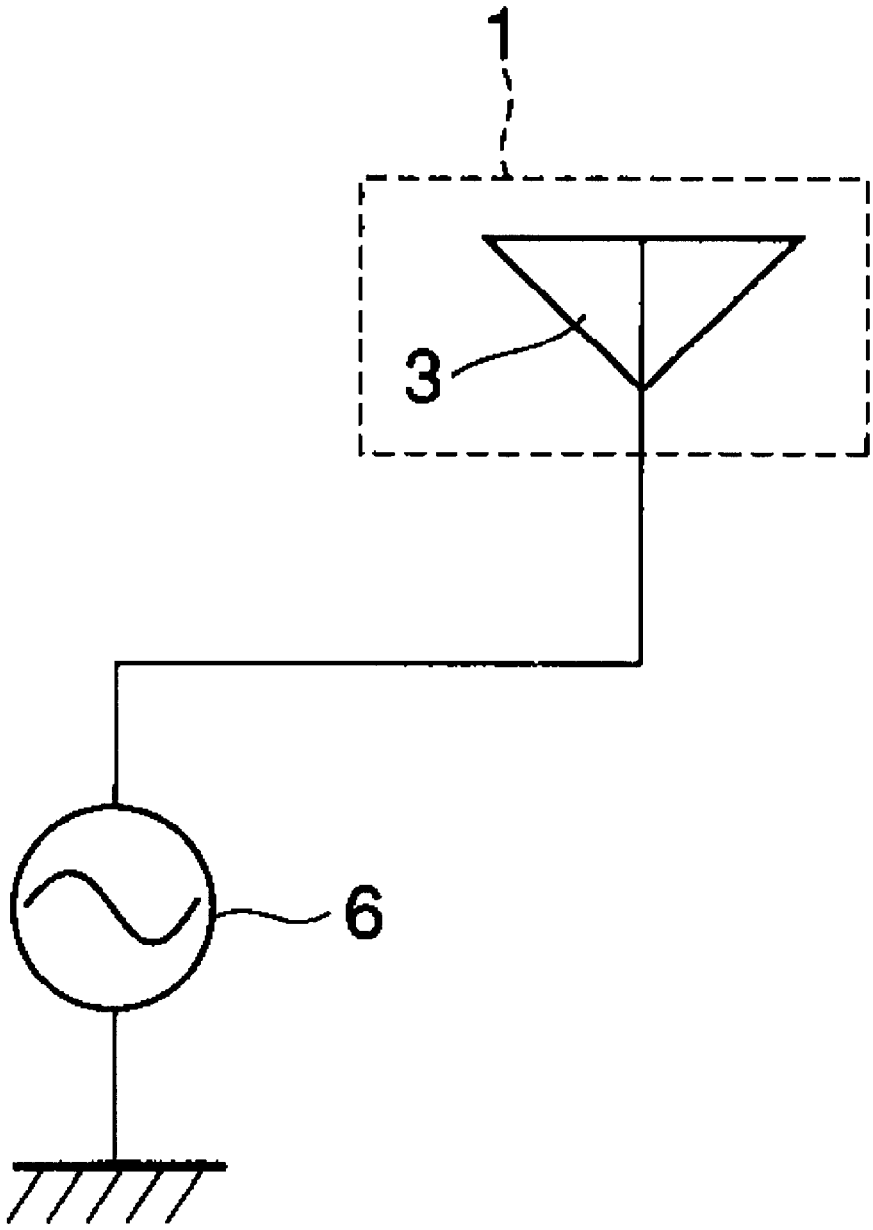

Such a surface mount antenna 1 can be, for instance, mounted on a circuit board of a radio communication apparatus, while one portion (disposed on the first shorter edge surface 2*b* of the substrate 2) of the radiation electrode 3 is connected to a signal supply source 6 of the radio communication apparatus. More specifically, in the first preferred embodiment, this one portion (corresponding to the first shorter edge surface 2*b*) of the radiation electrode 3 can function as a feeding section for receiving a signal from the signal supply source. Here, FIG. 1C is used to schematically show a relationship between the radiation electrode 3 and the signal supply source 6.

In this way, when signals are supplied from the signal supply source 6 to the surface mount antenna 1, almost all of these signals are allowed to go through the radiation electrode 3, from the feeding section (first shorter edge surface 2*b* of the substrate 2) to the open end K on the top surface 2*a*, passing through the bottom surface 2*c* and the second shorter edge surface 2*d*. By virtue of the signal supply, the radiation electrode 3 will perform a resonance action (an antenna action), thereby effecting a desired signal transmission and a desired signal reception.

However, in order for the radiation electrode 3 to perform a predetermined signal transmission and a predetermined signal reception using a predetermined frequency band, it is necessary for the radiation electrode 3 to have a resonance frequency corresponding to the predetermined frequency band. In fact, the resonance frequency of the radiation electrode 3 can be changed by changing an electric length of current carrying path which extends from the first shorter edge surface 2*b* (defining a feeding section of the radiation electrode 3), passes through the bottom surface 2*c* as well as the second shorter edge surface 2*d*, and arrives at the open end K on the top surface 2*a*. Further, the electric length of the radiation electrode 3 can also be changed and adjusted by changing the position and width H of the slit 4, as well as changing the length of a signal conducting path extending from the feeding section to the open end K.

In this way, according to the first preferred embodiment, it is possible to perform an experiment and simulation to determine an appropriate position and an appropriate width H for the slit 4, in such a manner that it is possible for the radiation electrode 3 to have an electric length that is capable of generated a predetermined resonance frequency. Then, the slit 4 can be formed on the top surface 2*a* of the substrate 2, thereby completing the formation of the slit in the radiation electrode in accordance with the slit position and the slit width H obtained in an experiment or a simulation.

Figure 2A:
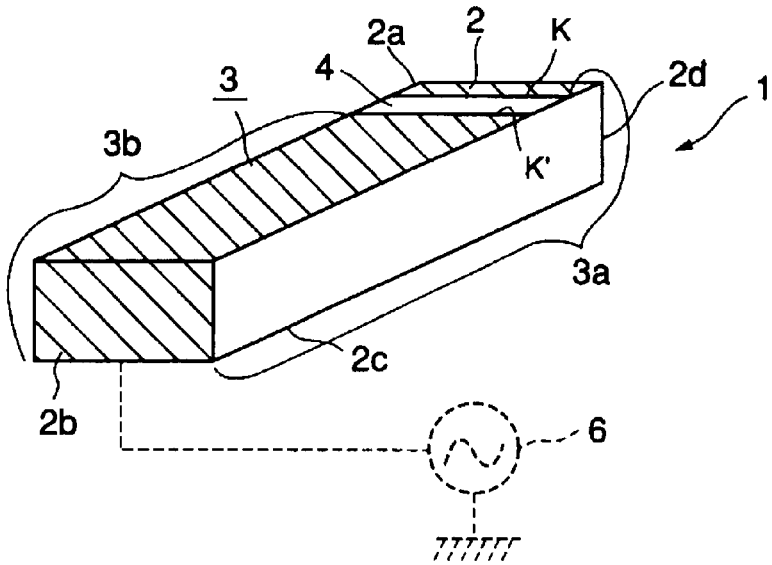
FIGS. 2A and 2B are explanatory views schematically showing an example of a surface mount antenna having a slit position that is different from that of the surface mount antenna shown in FIG. 1.
Figure 2B:
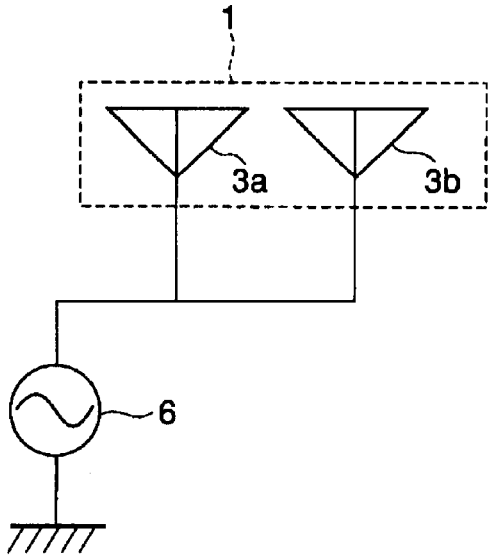

However, in view of a predetermined resonance frequency of the radiation electrode 3, it is also possible for the slit 4 to be formed on the top surface 2*a* of the substrate 2 but close to the second shorter edge surface 2*d*, as shown in FIG. 2A. In other words, the slit 4 may be located in such a position that it is separated from the feeding section of the radiation electrode 3. At this time, the radiation electrode 3 will be equipped with two functions functioning as two radiation electrodes 3*a* and 3*b* capable of transmitting and receiving signals (the radiation electrode 3*a* is formed to function in an area which extends from the feeding section, passes through the bottom surface 2*c* and the second shorter edge surface 2*d*, and arrives at the open end K on the top surface 2*a*, the radiation electrode 3*b* is formed to function in an area which extends from the feeding section to an open end K' on the front surface. FIG. 2B is an explanatory view schematically showing a relationship between the radiation electrodes 3*a*, 3*b* on one hand and the signal supply source 6 on the other.

In the case where the two radiation electrodes 3*a*, 3*b* have been formed, either one or two of the radiation electrodes 3*a*, 3*b* can be used to perform signal communication. Of course, the resonance frequency of each of the radiation electrodes 3*a* and 3*b* can be adjusted to a predetermined resonance frequency by adjusting the position and width of the slit 4. Moreover, the resonance frequency of the radiation electrode 3*a* and the resonance frequency of the radiation electrode 3*b* are preferably set separately from each other, so that the two resonance frequencies will not interfere with each other.

Figure 3A:
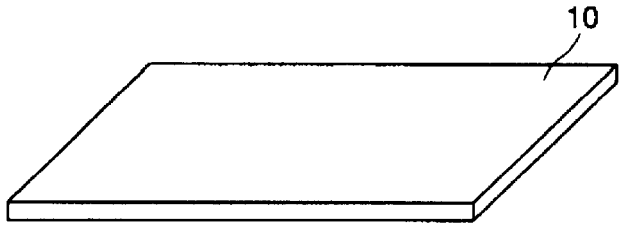
FIGS. 3A to 3D are explanatory views schematically showing a production flow for manufacturing the surface mount antenna according to the first preferred embodiment of the present invention.
Figure 3B:
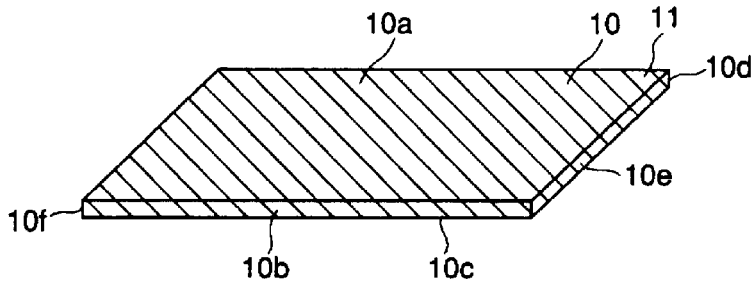

The surface mount antenna 1 formed according to the first preferred embodiment of the present invention may be manufactured according to a process shown in FIGS. 3A to 3B.

At first, it is necessary to prepare a dielectric substrate 10 shown in FIG. 3A. Such a dielectric substrate 10 is required to have a size such that it can be cut into a plurality of elongated portions each serving as a substrate 2 of a surface mount antenna 1. Then, the dielectric substrate 10 is plated in a manner shown in FIG. 3B so as to form an electrode 11. Here, since the plating treatment is conducted, the electrode 11 may be formed to cover the entire surface of the dielectric substrate 10 including a top surface 10*a*, a bottom surface 10*c*, and side edge surfaces 10*b*, 10*d*, 10*e* and 10*f*.

Figure 3C:
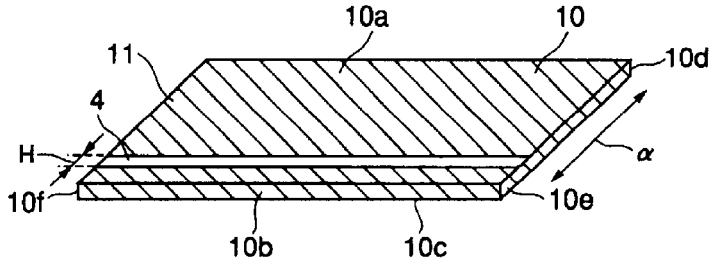

Then, as shown in FIG. 3C, a slit 4 is formed on the electrode 11. In more detail, the slit 4 is formed on the front surface 10*a* of the substrate 10 preferably via a dicer. Specifically, the slit 4 is formed to extend in a direction intersecting (in the present preferred embodiment, substantially perpendicular to) a direction $\alpha$ connecting two side edge surfaces 10*b* and 10*d* of the dielectric substrate 10, extending from the shorter edge surface 10*e* to the shorter edge surface 10*f*, having a substantially constant width H.

Specifically, the position and width H of the slit 4 may be set in advance according to a predetermined resonance frequency of the radiation electrode 3 of the surface mount antenna 1. Information about the position and the width H of the slit 4 are provided in advance to the controller of the dicer, so that the slit 4 may be formed in a process which can be controlled by automatically controlling the dicer using this information. In fact, the position and the width H of the slit 4 are parameters corresponding to a predetermined resonance frequency of the radiation electrode 3, so that these parameters may be set as needed without having to be limited to the position and the width H of the slit 4 shown in FIG. 3C.

Figure 3D:
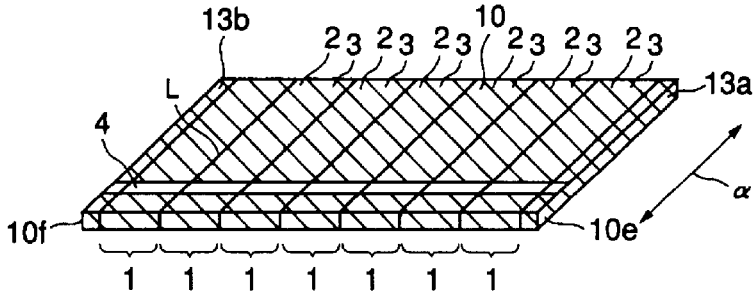

Subsequently, as shown in FIG. 3D, the dielectric substrate 10 is cut into a plurality of small portions, along a plurality of cutting lines L arranged in the direction $\alpha$, thereby forming a plurality of surface mount antennas 1 shown in FIG. 1A and FIG. 2A. However, in the cutting process for cutting the dielectric substrate 10 into a plurality of small portions, it is necessary to remove an end portion 13*a* on the end surface 10*e* of the dielectric substrate 10, as well as an end portion 13*b* on the end surface 10*f* of the same dielectric substance, thereby producing two side surfaces not involving the electrode 11 (radiation electrode 3).

According to the first preferred embodiment of the present invention, each radiation electrode 3 is disposed on four continuously connected surfaces of the substrate 2, thereby substantially covering the outer circumference of the substrate 2. Further, since each slit 4 is formed on the radiation electrode 3 in a manner such that it is oriented in a direction that is substantially perpendicular to the circumferential direction of the substrate 2, and since an open end K is formed in a simple manner shown in the drawings, it is possible to form an entire radiation electrode 3 having an extremely simple shape. Further, if the radiation electrode 3 is formed so that the position and the width H of the slit 4 are variable, it is possible to change an electric length extending from the feeder section to the open end K, thereby making it easy to change the resonance frequency. In this way, it is easy to adjust the resonance frequency of the radiation electrode 3 to a predetermined frequency. Moreover, it is also possible to easily and quickly perform a needed design change.

On the other hand, if the shape of the radiation electrode 3 is relatively complex, it will be necessary to carry out a positioning step for the formation of the radiation electrode 3 during a manufacturing process in which the radiation electrode 3 is formed on the dielectric substrate 10. Further, in the case where the positioning step fails to be carried out with a high precision, a cutting process for cutting the dielectric substrate 10 into a plurality of small portions, will suffer from the problem that the radiation electrode 3 will be broken, hence undesirably producing some surface mount antennas having almost no commercial value.

In contrast, in the first preferred embodiment of the present invention, since the radiation electrode 3 can be formed into an extremely simple shape, it becomes possible to simplify a corresponding manufacturing process. More specifically, the manufacturing process does not have to include a positioning step for determining the position of the radiation electrode 3. In fact, the manufacturing process only includes a step of forming an electrode 11 (radiation electrodes 3) on the entire surface of the dielectric substrate 10*a*, covering the top surface 10*a*, the side edge surface 10*b*, the bottom surface 10*c* and the side edge surface 10*d*, followed by forming the slit 4 and cutting the dielectric substrate 10 into a plurality of small portions preferably via a dicer, thereby making it easy to produce a plurality of surface mount antennas. In this way, it is possible to improve the yield of a production process for manufacturing the surface mount antenna 1.

Furthermore, using the method carried out in the first preferred embodiment of the present invention, it is possible to produce a plurality of surface mount antennas 1 during one operation. Therefore, in contrast to a conventional process in which each surface mount antenna 1 is produced by individually forming a radiation electrode on each substrate 2, the present invention makes it possible to greatly increase the production efficiency in manufacturing the surface mount antennas 1, thereby greatly reducing the production cost.

Moreover, according to the first preferred embodiment of the present invention, since the slit 4 can be formed by using a dicer and since using the dicer can ensure a high processing precision, it is possible to form the slit 4 with very high precision so that it can be produced exactly in accordance with a predetermined design. In this way, once each surface mount antenna 1 has been manufactured, it is possible to dispense with a frequency adjustment which is otherwise conventionally necessary for adjusting the resonance frequency of a radiation electrode 3 to a predetermined resonance frequency.

Further, since an identical dicer can be used to form the slit 4 and to cut the dielectric substrate 10 into a plurality of small portions, a series of operations can be continuously performed from the formation of the slit 4 to the cutting of the dielectric substrate 10. As a result, it is possible to manufacture the surface mount antenna 1 in a much shorter time period, thereby reducing the production cost.

Moreover, in manufacturing the surface mount antenna 1 using the process of the first preferred embodiment of the present invention, merely changing the preset parameters of the dicer can make it possible to change the formation position of the slit 4 as well as the width of the slit. Moreover, it is also possible to change the width of the substrate 2. In this way, it is possible to easily and quickly perform a needed design change for the surface mount antenna 1.

Next, a second preferred embodiment of the present invention will be described with reference to the accompanying drawings. In fact, the second preferred embodiment is almost the same as the first preferred embodiment, except that the second preferred embodiment includes another surface mount antenna manufacturing method that is different from that used in the first preferred embodiment. In the description of the second preferred embodiment, some elements which are the same as those used in the first preferred embodiment will be represented by the same reference numerals, and the same explanations thereof will be omitted.

Figure 4A:
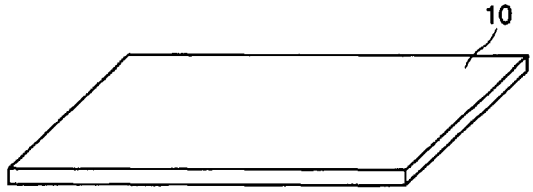
FIGS. 4A to 4D are explanatory views schematically showing a production flow for manufacturing the surface mount antenna according to a second preferred embodiment of the present invention.

The second preferred embodiment of the invention involves a process for manufacturing the same surface mount antenna as shown in FIG. 1A and FIG. 2A. As shown in FIG. 4A, the same step as used in the first preferred embodiment is used to prepare a dielectric substrate 10 which can be cut into a plurality of elongated substrates 2.

Figure 4B:
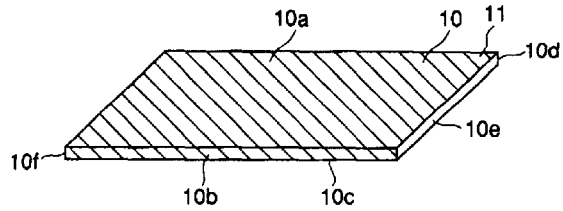

Then, as shown in FIG. 4B, a thick-film electrode formation method is preferably used to form an electrode 11 on the dielectric substrate 10. In more detail, for instance, an amount of paste-like electrode material is printed on to the dielectric substrate 10, followed by drying and sintering, thereby forming the electrode 11. More specifically, since the second preferred embodiment has used the thick-film electrode formation method, the electrode 11 may be selectively formed on four continuously connected surfaces selected from a total of six surfaces. Here, the four continuously connected surfaces preferably include a top surface 10*a*, a shorter edge surface 10*b*, a bottom surface 10*c* and a shorter edge surface 10*d* of the dielectric substrate 10.

Figure 4C:
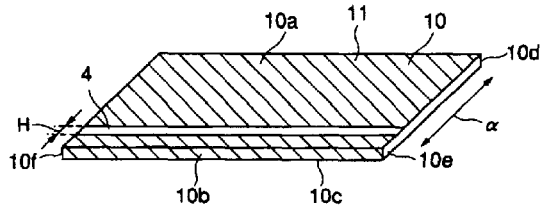
Figure 4D:
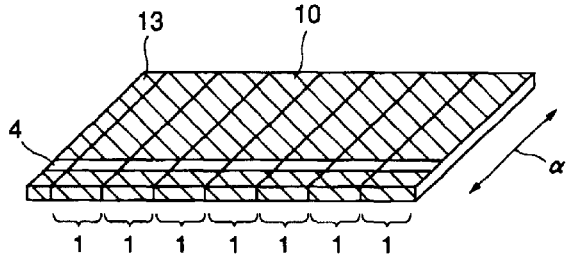

Afterwards, as shown in FIG. 4C, the same step as used in the first preferred embodiment is carried out to form the slit 4 on the electrode 11 formed on the top surface 10*a* of the dielectric substrate 10. Subsequently, as shown in FIG. 4D, the dielectric substrate 10 is cut into a plurality of elongated portions (along a direction connecting the shorter edge surface 10*b* with the shorter edge surface 10*d*), thereby forming a plurality of surface mount antennas 1, thus completing the process of manufacturing the surface mount antennas 1.

In this way, according to the second preferred embodiment of the present invention, it is possible to obtain the same excellent advantages as obtainable in the above-described first preferred embodiment. In addition, since the second preferred embodiment uses the thick-film formation method to form the electrode 11 on the dielectric substrate 10, it is possible to easily form the electrode 11 on the four surfaces 10*a*, 10*b*, 10*c* and 10*d* selected from the total of six surfaces of the dielectric substrate 10.

In other words, since no electrode is formed on the side edge surfaces 10*e* and 10*f* of the dielectric substrate 10, a process for producing the side surfaces not involving an electrode is not required (which process is needed to remove an end portion 13*a* from the shorter edge surface 10*e*, and to remove an end portion 13*b* from the shorter edge surface 10*f* of the dielectric substrate 10). In this way, according to the second preferred embodiment of the present invention, it is possible that the end portions of the dielectric substrate 10 may also be used as areas for forming the surface mount antennas 1, in a manner as shown in FIG. 4D, thereby avoiding the waste of a dielectric material. However, a reference numeral 13 shown in FIG. 4D is used to represent a remaining portion formed during a process of producing a predetermined number of the surface mount antennas 1 from the dielectric substrate 10.

Further, as described above, when the dielectric substrate 10 is cut into a plurality of elongated portions, it is not necessary to perform an operation for removing an end portion 13*a* from the shorter edge surface 10*e*, nor is it needed to remove an end portion 13*b* from the shorter edge surface 10*f*. As a result, in contrast to the process used in the above-described first preferred embodiment, it is possible to reduce the number of operations of cutting the dielectric substrate 10 using the dicer, thereby making it possible for an operation of cutting the dielectric substrate 10 to be completed during a shortened time period.

Next, description will be provided to explain a third preferred embodiment of the present invention. In fact, the third preferred embodiment is almost the same as the above-described first and second preferred embodiments except that the third preferred embodiment preferably uses a different process for manufacturing a surface mount antenna. However, in the description of the third preferred embodiment, the same elements as used in the above-described first and second preferred embodiments will be represent by the same reference numerals, and the same explanations thereof will be omitted. Actually, the third preferred embodiment is focused on a process for manufacturing the surface mount antenna 1, with reference to FIGS. 5A to 5E and FIGS. 6A to 6D. More exactly, FIGS. 5A to 5E are several explanatory views schematically showing a manufacturing process in which a plating treatment is carried out to form the electrode 11 on the dielectric substrate 10, and FIGS. 6A to 6D are also some explanatory views schematically showing a manufacturing process in which a thick-film electrode formation method is carried out to form the electrode 11 on the dielectric substrate 10.

Figure 5A:
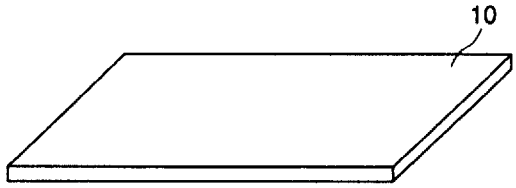
FIGS. 5A to 5E are explanatory views schematically showing a production flow involving a plating treatment, for manufacturing the surface mount antenna according to a third preferred embodiment of the present invention.
Figure 5B:
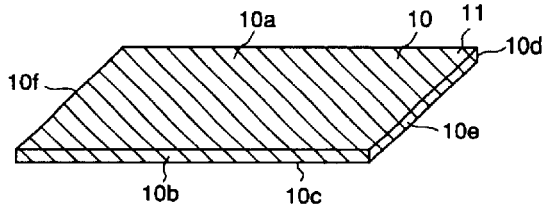

Similar to the above-described first and second preferred embodiments, the third preferred embodiment can be carried out by performing a plating treatment to form the electrode 11 which can cover a total of six surfaces of the dielectric substrate 10 shown in FIG. 5A, in a manner as shown in FIG. 5B. Alternatively, the thick-film electrode formation method can be carried out to form the electrode 11 on the four surfaces 10*a*, 10*b*, 10*c* and 10*d* selected from the total of six surfaces of the dielectric substrate 10.

Figure 5C:
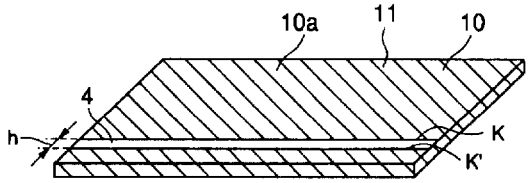
Figure 6A:
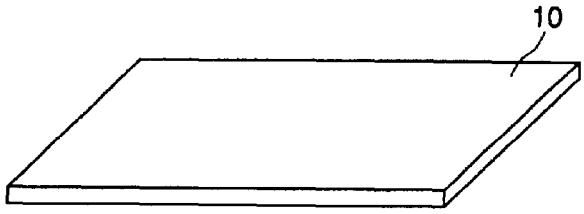
FIGS. 6A to 6D are explanatory views schematically showing a production flow involving the use of a thick-film electrode formation method, for manufacturing the surface mount antenna according to the third preferred embodiment of the present invention.
Figure 6B:
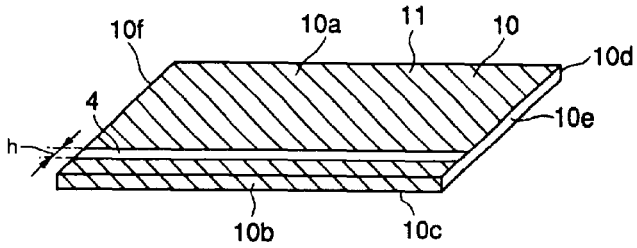

Then, as shown in FIG. 5C or FIG. 6B, an etching treatment is carried out to form the slit 4 on the electrode 11 previously formed on the top surface 10*a* of the dielectric substrate 10. At this time, the width h of the slit 4 will be slightly narrower than the slit width H which is necessary for the radiation electrode 3 of each surface mount antenna 1 to provide a predetermined resonance frequency.

Figure 5D:
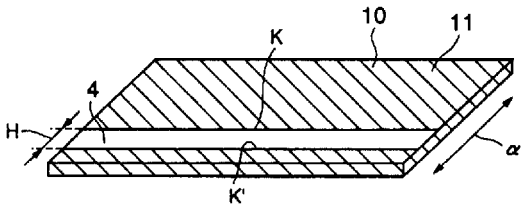
Figure 6C:
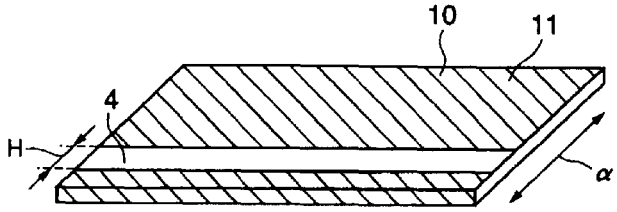

Subsequently, as shown in FIG. 5D or FIG. 6C, at least one of two electrode ends K and K' located close to each other with the slit 4 interposed therebetween is cut preferably via a dicer so as to enlarge the width of the slit 4 to a predetermined width H, thereby enabling the radiation electrode 3 of each surface mount antenna 1 to provide a predetermined resonance frequency. In other words, an electrode end (open end) K (or K') of each radiation electrode 3 is cut preferably via a dicer, in a manner such that the radiation electrode 3 of each surface mount antenna 1 will have an electric length capable of producing a predetermined resonance frequency.

Figure 5E:
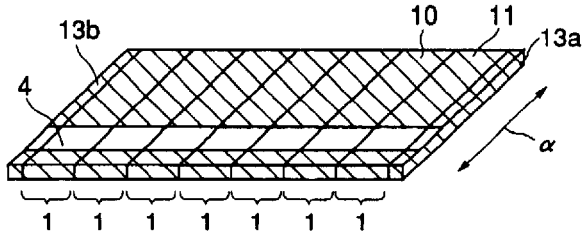
Figure 6D:
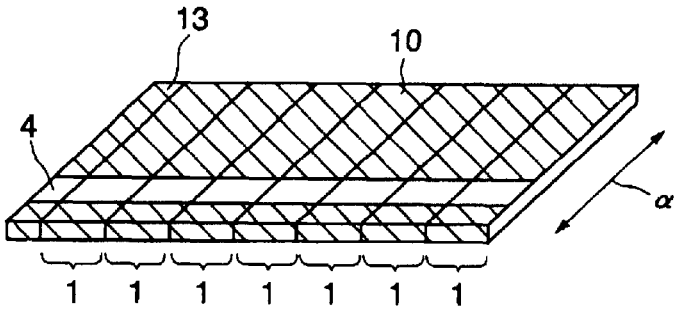

Afterwards, as shown in FIG. 5E or FIG. 6D, using the same method as used in the above-described preferred embodiments, the dielectric substrate 10 is cut into a plurality of elongated portions preferably via the dicer, thereby obtaining a plurality of surface mount antennas 1. In this way, it is exactly possible to produce desired surface mount antennas as shown in FIG. 1A and FIG. 2A.

Therefore, the third preferred embodiment of the present invention makes it possible to obtain the same advantages as obtainable in the above-described preferred embodiments. Further, in the third preferred embodiment, an etching treatment is performed to form the slit 4 on the electrode 11 previously formed on the surface 10*a* of the dielectric substrate 10. Then, a dicer is used to enlarge the width of the slit 4 to a predetermined width H corresponding to a predetermined resonance frequency of the radiation electrode 3. In this manner, it is possible to adjust the resonance frequency of the radiation electrode 3 of each surface mount antenna 1 to a predetermined resonance frequency, thereby obtaining some advantages which will be described later.

Nevertheless, in a conventional method, when a dicer is caused to move relatively over the dielectric substrate 10 from one shorter edge surface 10*e* towards the other shorter edge surface 10*f* to form the slit 4, the slit thus formed by virtue of the dicer during one movement has only an extremely narrow width. Thus, if the width H of the slit 4 is to be made large, and if such a large width is to be made constant along the entire length of the slit 4, it is necessary to move the dicer reciprocatingly along the slit many times, hence requiring an extended operation time for forming the slit 4.

In contrast to the above-discussed conventional method, in the third preferred embodiment of the present invention, since the dicer is used only to perform a fine adjustment of the width of the slit 4, it is possible to reduce the number of times for repeating the reciprocating movement of the dicer, thereby making it possible to shorten a time period necessary for completing the cutting treatment using the dicer. In fact, the manufacturing method used in the third preferred embodiment has been proved to be extremely effective in forming a slit having a relatively large width.

Further, before the dielectric substrate 10 is cut into a plurality of elongated portions, the width of the slit 4 is adjusted so as to adjust the resonance frequency of the radiation electrode 3. In this way, it is possible to obtain higher production efficiency in manufacturing the surface mount antenna than a conventional method in which the resonance frequency of each radiation electrode 3 is adjusted only after a plurality of surface mount antennas 1 have been separated from one another.

However, the present invention is not be limited to the above-described preferred embodiments, but is allowed to have various other preferred embodiments and variants. More specifically, although FIG. 3 to FIG. 6 show that seven surface amount antennas 1 are produced from a dielectric substrate 10, the number of the surface mount antennas 1 obtainable from one dielectric substrate 10 should not be limited, but can be properly increased or decreased.

Although each of the above-described preferred embodiments preferably uses a plating treatment or a thick-film electrode formation method for forming the electrode 11 on the dielectric substrate 10, it is also possible to use one of any other electrode formation methods to form the electrode 11 on the dielectric substrate 10.

According to various preferred embodiments of the present invention, the radiation electrode of each surface mount antenna is formed to cover the four continuously connected surfaces including a front end surface, a front surface, an area end surface and a rear surface of the dielectric substrate, thereby forming a configuration essentially surrounding the outer circumference of the substrate, thus forming an improved radiation electrode having an extremely simple shape. Further, a slit is formed in a direction intersecting the circumferential direction of the substrate and extends across the whole width of the radiation electrode. Moreover, since the slit position and the slit width are variable, it is possible to change an electric length extending from the feeding section predetermined in the radiation electrode to an electrode end (open end) which is an edge of the slit, thereby making it possible to change the resonance frequency of the radiation electrode.

Further, according to preferred embodiments of the present invention, a dicer may preferably be used to cut at least one of the two electrode ends located close to each other with the slit interposed therebetween, thereby adjusting an electric length of the radiation electrode and thus, the resonance frequency of the radiation electrode. In this way, since a dicer can be used to process an electrode with very high precision, it is possible to adjust (with an improved precision) the resonance frequency of the radiation electrode, thereby increasing the reliability of each surface mount antenna and each radio communication apparatus equipped with such an improved surface mount antenna.

Moreover, since the resonance frequency of the radiation electrode can be adjusted simply by changing the slit position and the slit width, it is possible to easily and quickly perform any designing change.

Further, in preferred embodiments of the present invention, the radiation electrode is preferably formed to cover the front end surface, the front surface, the rear end surface and the rear surface of each substrate, thereby forming an arrangement essentially surrounding an outer circumference of the substrate. Afterwards, a slit is formed on the radiation electrode. In this way, the surface mount antenna including the radiation electrode and the slit has an extremely simple shape. Therefore, the surface mount antenna can be easily produced by using the manufacturing method of the present invention, which method includes forming an electrode covering the front and rear surfaces as well as the front and rear end surfaces of a dielectric substrate, using a dicer to cut a slit on the electrode formed on the surface of the dielectric substrate (alternatively, to increase the width of the slit formed on the electrode), cutting the dielectric substrate into a plurality of portions and thus, producing a plurality of surface mount antennas. In addition, since a plurality of surface mount antennas can be produced in only one operation, it is possible to greatly improve the production efficiency for manufacturing the surface mount antenna, thereby reducing the production cost.

Besides, under a condition where a slit has been provided on an electrode formed on the surface of the dielectric substrate, the resonance frequency of each radiation electrode can be adjusted by cutting an electrode end using a dicer. As a result, since the dicer is used only to perform a fine adjustment of the slit width, it is possible to shorten an operation time necessary for performing a cutting treatment using the dicer.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A surface mount antenna comprising:

a substrate; and a radiation electrode disposed on the substrate and arranged to perform an antenna function; wherein the radiation electrode is disposed on four continuously connected surfaces of the substrate including a top surface, a bottom surface, and two shorter edge surfaces of the substrate, thereby defining a configuration in which the radiation electrode essentially surrounds an outer circumference of the substrate;

a slit is formed in the radiation electrode in a direction intersecting an outer circumference of the substrate and extends across the whole width of the radiation electrode;

at least one of two electrode ends located close to each other with the slit interposed therebetween is cut for adjusting the resonance frequency of the radiation electrode; and the radiation electrode extends across substantially an entire width of the substrate.

2. A surface mount antenna according to claim 1, wherein the substrate has a substantially rectangular shape and is made of a dielectric material.

3. A surface mount antenna according to claim 1, wherein the slit has a width that is substantially constant along the entire length of the slit.

4. A surface mount antenna according to claim 1, wherein one portion of the radiation electrode is arranged to function as a feeding section for receiving a signal from a signal supply source.

5. A surface mount antenna according to claim 1, wherein the slit is formed in a position that is separated from feeding section.

6. A surface mount antenna according to claim 1, wherein the slit is formed on the top surface of the substrate and close to one of the two shorter edge surfaces of the substrate.

7. A radio communication apparatus comprising a surface mount antenna according to claim 1.

8. A method of manufacturing a surface mount antenna, comprising the steps of:

providing a substrate;

forming an electrode to entirely cover top and bottom surfaces as well as two mutually opposite shorter edge surfaces of the substrate;

forming a slit in the electrode disposed on the surface of the substrate, the slit being formed by cutting with a dicer and so as to extend in a direction intersecting a direction connecting the two shorter edge surfaces;

cutting the dielectric substrate into a plurality of portions, using a dicer which cuts along the direction connecting the two shorter edge surfaces; and producing a plurality of surface mount antennas each including a substantially rectangular substrate and a radiation electrode disposed so as to essentially surround the substantially rectangular substrate; wherein when the dicer is used to cut the slit so that the slit is formed on the electrode attached to the surface of the substrate, said slit is formed in a position and has a width both corresponding to a predetermined resonance frequency of the radiation electrode of a surface mount antenna.

9. A method according to claim 8, wherein one of a plating treatment and a thick-film electrode formation method is used to form the electrode on the substrate.

10. A method according to claim 8, wherein the substrate is made of a dielectric material.

11. A method according to claim 8, wherein information about the position and the width of the slit is provided in advance to a controller of the dicer before the dicer forms the slit.

12. A method according to claim 8, wherein no frequency adjustment step is performed to adjust the resonance frequency of the radiation electrode to a predetermined resonance frequency.

13. A method according to claim 8, wherein the slit has a width that is substantially constant along the entire length of the slit.

14. A method according to claim 8, wherein one portion of the radiation electrode is arranged to function as a feeding section for receiving a signal from a signal supply source.

15. A method according to claim 14, wherein the slit is formed in a position that is separated from the feeding section.

16. A method according to claim 8, wherein the slit is formed on the top surface of the substrate and close to one of the two shorter edge surfaces of the substrate.

17. A method of manufacturing a surface mount antenna, comprising the steps of:

providing a substrate;

forming a first electrode to entirely cover a bottom surface and two mutually opposed shorter edge surfaces of the substrate;

forming on a top surface of the substrate second electrode having a slit formed in a direction intersecting a direction connecting the two shorter edge surfaces;

cutting the substrate into a plurality of portions, using a dicer which cuts along the direction connecting the two shorter edge surfaces; and producing a plurality of surface mount antennas each including a substantially rectangular substrate and a radiation electrode disposed so as to essentially surround the substantially rectangular substrate; wherein before the substrate is cut by a dicer into a plurality of portions, at least one of two electrode ends located close to each other with the slit interposed therebetween is cut by the dicer, so as to adjust the resonance frequency of the radiation electrode of each surface mount antenna to a predetermined resonance frequency.

18. A method according to claim 17, wherein one of a plating treatment and a thick-film electrode formation method is used to form at least one of the first and second electrodes on the substrate.

19. A method according to claim 17, wherein the substrate is made of a dielectric material.

20. A method according to claim 17, wherein information about the position and the width of the slit is provided in advance to a controller of the dicer before the dicer forms the slit.

21. A method according to claim 17, wherein no frequency adjustment step is performed to adjust the resonance frequency of the radiation electrode to a predetermined resonance frequency.

22. A method according to claim 17, wherein the slit has a width that is substantially constant along the entire length of the slit.

23. A method according to claim 17, wherein one portion of the radiation electrode is arranged to function as a feeding section for receiving a signal from a signal supply source.

24. A method according to claim 23, wherein the slit is formed in a position that is separated from the feeding section.

25. A method according to claim 17, wherein the slit is formed on the top surface of the substrate and close to one of the two shorter edge surfaces of the substrate.

* * * * *